US012049687B2

(12) United States Patent
Kim et al.

(10) Patent No.: US 12,049,687 B2
(45) Date of Patent: Jul. 30, 2024

(54) HIGH-STRENGTH STEEL HAVING HIGH YIELD RATIO AND EXCELLENT DURABILITY, AND METHOD FOR MANUFACTURING SAME

(71) Applicant: POSCO, Pohang-si (KR)

(72) Inventors: Sung-Il Kim, Gwangyang-si (KR); Hyun-Taek Na, Gwangyang-si (KR)

(73) Assignee: POSCO, Pohang-si (KR)

( * ) Notice: Subject to any disclaimer, the term of this patent is extended or adjusted under 35 U.S.C. 154(b) by 0 days.

(21) Appl. No.: 17/773,401

(22) PCT Filed: Oct. 26, 2020

(86) PCT No.: PCT/KR2020/014670
§ 371 (c)(1),
(2) Date: Apr. 29, 2022

(87) PCT Pub. No.: WO2021/091140
PCT Pub. Date: May 14, 2021

(65) Prior Publication Data

US 2022/0389548 A1 Dec. 8, 2022

(30) Foreign Application Priority Data

Nov. 4, 2019 (KR) ..... 10-2019-0139220

(51) Int. Cl.
*C22C 38/28* (2006.01)
*C21D 8/02* (2006.01)
(Continued)

(52) U.S. Cl.
CPC ..... *C22C 38/28* (2013.01); *C21D 8/0226* (2013.01); *C21D 9/46* (2013.01); *C22C 38/001* (2013.01);
(Continued)

(58) Field of Classification Search
None
See application file for complete search history.

(56) References Cited

U.S. PATENT DOCUMENTS

2014/0007993 A1 1/2014 Nakajima et al.
2014/0178712 A1 6/2014 Maruyama et al.
(Continued)

FOREIGN PATENT DOCUMENTS

CA 2762935 A1 12/2010
CN 103732776 A 4/2014
(Continued)

OTHER PUBLICATIONS

Extended European Search Report dated Nov. 7, 2022 issued in European Patent Application No. 20884353.2.
(Continued)

*Primary Examiner* — Seth Dumbris
(74) *Attorney, Agent, or Firm* — Morgan, Lewis & Bockius LLP

(57) ABSTRACT

Thick high-strength steel having a high yield ratio and excellent durability, and a method for manufacturing same are provided. The thick high-strength steel having a high yield ratio and excellent durability of the present invention comprises, in percentage by weight, C: 0.05 to 0.15%, Si: 0.01 to 1.0%, Mn: 1.0 to 2.3%, Al: 0.01 to 0.1%, Cr: 0.005 to 1.0%, P: 0.001 to 0.05%, S: 0.001 to 0.01%, N: 0.001 to 0.01%, Nb: 0.005 to 0.07%, Ti 0.005 to 0.11%, Fe and unavoidable impurities.

6 Claims, 1 Drawing Sheet

(51) Int. Cl.

| | |
|---|---|
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/26*** | (2006.01) |
| ***C23C 2/06*** | (2006.01) |
| ***C23C 2/12*** | (2006.01) |
| ***C23C 2/40*** | (2006.01) |
| ***C23G 1/00*** | (2006.01) |

(52) U.S. Cl.

CPC ..... *C22C 38/002* (2013.01); *C22C 38/02* (2013.01); *C22C 38/04* (2013.01); *C22C 38/06* (2013.01); *C22C 38/26* (2013.01); *C23C 2/06* (2013.01); *C23C 2/12* (2013.01); *C23C 2/40* (2013.01); *C23G 1/00* (2013.01); *C21D 2211/001* (2013.01); *C21D 2211/002* (2013.01); *C21D 2211/005* (2013.01); *C21D 2211/008* (2013.01); *C21D 2211/009* (2013.01); *Y10T 428/12799* (2015.01)

(56) References Cited

U.S. PATENT DOCUMENTS

| | | | | |
|---|---|---|---|---|
| 2015/0004433 | A1* | 1/2015 | Tanaka | C21D 8/0205 148/333 |
| 2018/0044754 | A1* | 2/2018 | Azuma | C22C 38/28 |
| 2018/0363090 | A1 | 12/2018 | Koo et al. | |
| 2019/0177822 | A1* | 6/2019 | Maeda | C22C 38/005 |
| 2020/0248280 | A1 | 8/2020 | Minami et al. | |
| 2021/0010098 | A1 | 1/2021 | Na et al. | |

FOREIGN PATENT DOCUMENTS

| | | | | |
|---|---|---|---|---|
| CN | 108431280 | A | | 8/2018 |
| JP | H09-143570 | A | | 6/1997 |
| JP | H11-106861 | A | | 4/1999 |
| JP | H11-140542 | A | | 5/1999 |
| JP | H11-310852 | A | | 11/1999 |
| JP | 2000-297350 | A | | 10/2000 |
| JP | 2000297350 | A | * | 10/2000 |
| JP | 2015-116596 | A | | 6/2015 |
| JP | 2015-175004 | A | | 10/2015 |
| JP | 2016-141848 | A | | 8/2016 |
| JP | 2018-90896 | A | | 6/2018 |
| KR | 10-2006-0033489 | A | | 4/2006 |
| KR | 10-1528084 | B1 | | 6/2015 |
| KR | 10-2015-0074943 | A | | 7/2015 |
| KR | 10-1630977 | B1 | | 6/2016 |
| KR | 10-2016-0077418 | A | | 7/2016 |
| KR | 10-1988765 | B1 | | 6/2019 |
| WO | 2016/152135 | A1 | | 9/2016 |

OTHER PUBLICATIONS

Chinese Office Action dated Dec. 16, 2022 issued in Chinese Patent Application No. 202080077667.5.

Key to Metals AG: "Residual Elements in Steel"(Jul. 1, 2007) (URL : http://www.keytometals.com/page.aspx?ID=CheckArticle&site=kts&LN=DE&NM=205).

International Search Report dated Jan. 27, 2021 issued in International Patent Application No. PCT/KR2020/014670 (with English translation).

* cited by examiner

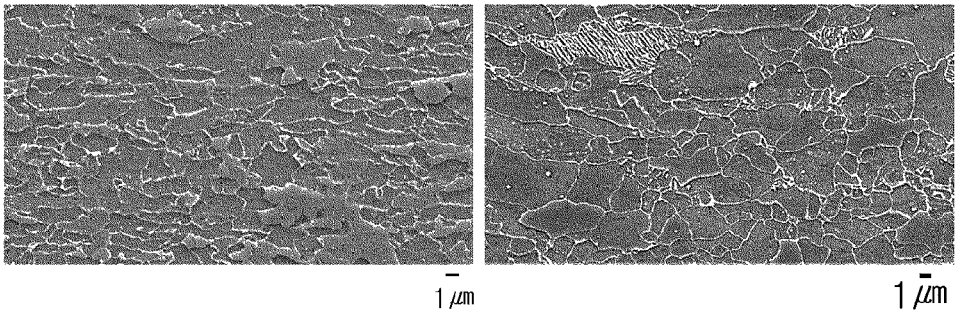
(A) (B)

HIGH-STRENGTH STEEL HAVING HIGH YIELD RATIO AND EXCELLENT DURABILITY, AND METHOD FOR MANUFACTURING SAME

CROSS-REFERENCE OF RELATED APPLICATIONS

This application is the U.S. National Phase under 35 U.S.C. § 371 of International Patent Application No. PCT/KR2020/014670, filed on Oct. 26, 2020, which in turn claims the benefit of Korean Application No. 10-2019-0139220, filed on Nov. 4, 2019, the entire disclosures of which applications are incorporated by reference herein.

TECHNICAL FIELD

The present invention relates to manufacturing of a high-strength hot-rolled steel sheet having a thickness of 5 mm or more used for members of a chassis portion and a wheel rim for a commercial vehicle, and more particularly, to a high-strength hot-rolled steel sheet having a high yield ratio that has a tensile strength of 650 MPa or more and satisfies a ratio of fatigue limit of a steel sheet and yield strength of the steel sheet of 0.15 or more and a yield ratio of 0.8 or more after punch forming because a quality of a cross-section is excellent during shear forming and the punch forming, and a method for manufacturing same.

BACKGROUND ART

In order to secure high rigidity of members of chassis portions and wheel rims of commercial vehicles due to characteristics of the vehicles, the conventional high-strength hot-rolled steel sheet having a thickness of 5 mm or more and a tensile strength of 440 to 590 MPa has been used, but recently, a technology of using high-strength steel having a tensile strength of 650 MPa or more has been developed for weight reduction and high strength. In addition, in order to increase weight reduction efficiency, parts are manufactured by being subjected to shear forming and multiple punch forming during the manufacturing of the parts within a range that durability is secured, which results in shortening a durability life of parts with minute cracks formed in punched portions of a steel sheet during the shear and punch forming.

In this regard, as the related art, a technology (Patent Documents 1 and 2) of using a ferrite phase as a matrix structure by coiling at a high temperature after performing typical hot rolling in austenite region and finely forming precipitates has been proposed. Also, a technology (Patent Document 3) of performing coiling after cooling a coiling temperature to a temperature at which a bainite phase is formed into a matrix structure so as not to form the coarse pearlite structure, etc., have been proposed. In addition, a technology (Patent Document 4) for refining austenite grains by applying a pressure of 40% or more in a non-recrystallization region during the hot rolling using Ti, Nb, etc., has also been proposed.

However, alloy components such as Si, Mn, Al, Mo, and Cr, which are mainly used to manufacture such high-strength steels, are effective in improving the strength of the hot-rolled steel sheet, so it is necessary for thick products for commercial vehicles. However, when a lot of alloy components are added, since non-uniformity may be caused in a microstructure, during the shear or punch forming, micro-cracks that are easily generated in the punched portion may be easily propagated to fatigue cracks in a fatigue environment, resulting in damage to parts. In particular, as a thickness of the steel sheet increases, that a center of the thickness of the steel sheet is likely to be slowly cooled during manufacturing increases, so the non-uniformity of the structure further increases and the propagation speed of fatigue cracks also increases in the fatigue environment, resulting in deteriorating the durability.

However, the above-described related art does not take into account fatigue properties of a high-strength thick material. In addition, it is effective to use precipitate-forming elements such as Ti, Nb, and V to refine grains of the thick material and obtain a precipitation strengthening effect. However, when the coilin is carried out at a high temperature of 500 to 700° C. which is easy to form precipitates, or a cooling rate of the steel sheet is not controlled during the cooling after hot rolling, coarse carbides are formed in the center of a thickness of the thick material, so the quality of the shear cross section quality deteriorates, and furthermore, applying a 40% large rolling reduction in the non-recrystallization region during the hot rolling deteriorates the quality of the shape of the rolled sheet and increases a load on the equipment, making it difficult to apply in practice.

RELATED ART DOCUMENT

Patent Document (Patent Document 1) Japanese Patent Application No. H9-308808.

(Patent Document 2) Japanese Patent Application No. H9-279379.

(Patent Document 3) Korea Patent No. 10-1528084

(Patent Document 4) Japanese Patent Laid-Open Publication No. H9-143570

DISCLOSURE

Technical Problem

The present invention provides a high-strength hot-rolled steel sheet having a high yield ratio that has a tensile strength of 650 MPa or more and satisfies a ratio of fatigue limit of a steel sheet and yield strength of the steel sheet of 0.15 or more and a yield ratio of 0.8 or more after punch forming because a quality of a cross-section is excellent during shear forming and the punch forming, and a method for manufacturing same.

An object of the present invention is not limited to the above-described contents. The problems of the present invention will be understood from the overall content of this specification, and those of ordinary skill in the art to which the present invention pertains will have no difficulty in understanding additional problems of the present invention.

Technical Solution

In an aspect of the present invention, a thick high-strength steel having a high yield ratio and excellent durability may comprise:

in percentage by weight, C: 0.05 to 0.15%, Si: 0.01 to 1.0%, Mn: 1.0 to 2.3%, Al: 0.01 to 0.1%, Cr: 0.005 to 1.0%, P: 0.001 to 0.05%, S: 0.001 to 0.01%, N: 0.001 to 0.01%, Nb: 0.005 to 0.07%, Ti: 0.005 to 0.11%, and Fe, and unavoidable impurities; and a microstructure comprising, in percentage by area, less than 5% of a pearlite phase including nitrides and coarse carbides having a diameter of 1 μm or more, less than 10% of a bainite phase, and less than 5% of a martensite and austenite (MA) phase, and the remaining of a ferrite phase, in which a ratio of fatigue limit and yield strength is 0.15 or more and a yield ratio is 0.8 or more.

The high-strength steel may be a pickled and oiled steel.

In another aspect of the present invention, a method for manufacturing a thick high-strength steel having a high yield ratio and excellent durability may comprise:

reheating a steel slab comprising, in percentage by weight, C: 0.05 to 0.15%, Si: 0.01 to 1.0%, Mn: 1.0 to 2.3%, Al: 0.01 to 0.1%, Cr: 0.005 to 1.0%, P: 0.001 to 0.05%, S: 0.001 to 0.01%, N: 0.001 to 0.01%, Nb: 0.005 to 0.07%, Ti 0.005 to 0.11%, Fe and unavoidable impurities at a temperature of 1200 to 1350° C.; and producing a hot-rolled steel sheet by performing finish hot rolling on the reheated steel slab at a finish hot rolling temperature (FDT) satisfying the following [Relational Expression 1]; and cooling the hot-rolled steel sheet at a cooling rate (CR) that satisfies the following [Relational Expression 2] to a cooling termination temperature in a range of 450 to 650° C., and then coiling the hot-rolled steel sheet, in which, when a length of the hot-rolled steel sheet constituting a coiled coil is L, an average cooling termination temperature range for a corresponding portion of the hot-rolled steel sheet to a 0 to L/5 region of a head portion of the coiled coil is controlled to A1 (550 to 650° C.)

the average cooling termination temperature range for the corresponding portion of the hot-rolled steel sheet to a L/5 to 2L/3 region of the coiled coil is controlled to A2 (450 to 550° C.)

the average cooling termination temperature range for the corresponding portion of the hot-rolled steel sheet to a 2L/3 to L region of the coiled coil is controlled to A3 (550 to 650° C.), and the A1-A2 and A3-A2 values are controlled at 100° C. or higher, respectively.

$$Tn-50 \leq FDT \leq Tn$$

$$Tn=730+92\times[C]+70\times[Mn]+45\times[Cr]+780\times[Nb]+520\times[Ti]-80\times[Si]-1.4\times(t-5) \quad \text{[Relational Expression 1]}$$

C, Mn, Cr, Nb, Ti, and Si in the above Relational Expression 1 are % by weight of the corresponding alloy element.

the FDT of the above Relational Expression 1 is a temperature (° C.) of a hot-rolled sheet at a termination time point of hot rolling, t of the Relational Expression 1 is a thickness of a final rolled sheet material (mm), $$CR \geq 196-300\times[C]+4.5\times[Si]-71.8\times[Mn]-59.6\times[Cr]+187\times[Ti]+852\times[Nb] \quad \text{[Relational Expression 2]}$$

in the above Relational Expression 2, the CR is a cooling rate (° C./sec) during cooling to an A2 average cooling termination temperature after the FDT, and C, Si, Mn, Cr, Ti, and Nb in the above Relational Expression 2 are % by weight of the corresponding alloy element.

the high-strength steel may have a microstructure comprising, in percentage by area, less than 5% of a pearlite phase including nitrides and coarse carbides having a diameter of 1 μm or more, less than 10% of a bainite phase, and less than 5% of a martensite and austenite (MA) phase, and the remaining of a ferrite phase, and have a ratio of fatigue limit and yield strength of 0.15 or more and a yield ratio of 0.8 or more.

The method may further include pickling and lubricating the coiled steel sheet after the secondary cooling.

The method may further include heating the pickled or oiled steel sheet to a temperature in a range of 450 to 740° C., followed by hot-dip galvanizing.

The hot-dip galvanizing may use a plating bath including 0.01 to 30% by weight of magnesium (Mg), 0.01 to 50% by weight of aluminum (Al), the remaining of Zn, and unavoidable impurities.

Advantageous Effects

According to the present invention of the above configuration, it is possible to effectively provide a thick high-strength steel having a high yield ratio that has a microstructure of a center of a thickness including, in percentage by area, less than 5% of a pearlite phase including nitrides and coarse carbides having a diameter of 1 μm or more, less than 10% of a bainite phase, and less than 5% of a martensite and austenite (MA) phase, and the remaining of a ferrite phase, and has a ratio of fatigue limit and yield strength of 0.15 or more, a yield ratio 0.8 or more, and a tensile strength of 600 MPa.

BRIEF DESCRIPTION OF THE DRAWINGS

FIG. 1 is a photograph of observed microstructures of Inventive Example 5 in Examples of the present invention and Comparative Example 3.

BEST MODE

Hereinafter, the present invention will be described.

In order to solve the problems of the related art described above, the present inventors investigated a change of crack distribution and durability in a shear cross section according to characteristics of components and microstructures for thick rolled steels having various components with different microstructures. As a result, the present inventors confirmed a method for making a thick hot-rolled steel sheet have excellent durability and a high yield ratio. In particular, the present inventors confirmed that, when a pearlite phase including nitride and coarse carbide having a diameter of 1 μm or more in a microstructure of a center of a thickness is less than 5%, there is no crack in the shear cross section and the durability is excellent.

In general, in the hot-rolled steel sheet produced in the form of a coil, the coarse carbide and pearlite phase are easy to form when maintained at a high temperature in a range of about 500 to 700° C. for a long time. In particular, when a ferrite phase transformation initiated in the cooling process after a termination of hot rolling proceeds slowly, the solid solution amount of carbon increases in an untransformed phase, so it is easy to form the coarse carbide or pearlite structure. Moreover, the cooling rate of an inner coiling portion of the coil is slower than that of an outer coiling portion thereof, so the carbide and the pearlite structure are further developed. Therefore, in order to suppress the formation of such coarse carbide and pearlite structure in the inner coiling portion of the coil, it is necessary to cool the coiled coil to room temperature through forced cooling such as water cooling. In this case, the outer coiling portion and the edge portion of the rolled sheet, which are subject to fast cooling rate, form a non-uniform microstructure according the formation of a martensite phase or martensite and austenite (MA) phases in microstructures, so it is difficult to obtain high yield strength and increase the cracks of the shear cross section, which is not preferable. Therefore, there is a need for a method capable of suppressing a formation of a coarse carbide and pearlite structure without forcibly cooling a coil.

To this end, the present invention suggests the following Relational Expressions 1 and 2 and suggests a method of differently controlling an average cooling termination temperature range of a hot-rolled steel sheet corresponding to outer and inner coiling portions of a coiling coil.

The thick high-strength steel having a high yield ratio and excellent durability of the present invention comprises, in percentage by weight, C: 0.05 to 0.15%, Si: 0.01 to 1.0%, Mn: 1.0 to 2.3%, Al: 0.01 to 0.1%, Cr: 0.005 to 1.0%, P: 0.001 to 0.05%, S: 0.001 to 0.01%, N: 0.001 to 0.01%, Nb: 0.005 to 0.07%, Ti: 0.005 to 0.11%, Fe, and unavoidable impurities, and has a microstructure including, in percentage by area, less than 5% of a pearlite phase including nitrides and coarse carbides having a diameter of 1 μm or more, less than 10% of a bainite phase, and less than 5% of a martensite and austenite (MA) phase, and the remaining of a ferrite phase a microstructure including the remainder ferrite phase, in which a ratio of fatigue limit to yield strength is 0.15 or more, and a yield ratio is 0.8 or more.

Hereinafter, the alloy composition components and the reasons for limiting the content thereof of the present invention will be described. Meanwhile, in the following steel alloy components, "%" means "weight" unless otherwise specified.

C: 0.05 to 0.15%

C is the most economical and effective element for strengthening steel, and when the amount added increases, a precipitation strengthening effect or a fraction of bainite phase increases, thereby increasing a tensile strength. In addition, when the thickness of the hot-rolled steel sheet increases, the cooling rate in the center of the thickness during cooling after hot rolling is slow, so coarse carbide or pearlite is easy to form when the content of C is high. Therefore, when the content is less than 0.05%, it is difficult to obtain a sufficient strengthening effect, and when the content exceeds 0.15%, there is a problem in that the shear formability deteriorates and the durability deteriorates due to the formation of the pearlite phase or coarse carbide in the center of the thickness, and weldability also deteriorates. Therefore, in the present invention, the content of C is preferably limited to 0.05 to 0.15%. More preferably, the content of C is limited to 0.06 to 0.12%.

Si: 0.01 to 1.0%

Si deoxidizes a molten steel and has a solid solution strengthening effect, and is advantageous in improving the formability by delaying the formation of the coarse carbide. However, there is a problem that, when the content is less than 0.01%, the solid solution strengthening effect is small and the effect of delaying the formation of carbide is small, so it is difficult to improve the formability, and when the content exceeds 1.0%, a red scale due to Si is formed on a surface of the steel sheet during the hot rolling, thereby not only severely reducing the quality of the surface of the steel sheet, but also reducing ductility and weldability. Therefore, in the present invention, it is preferable to limit the content of Si in the range of 0.01 to 1.0%, and more preferably 0.2 to 0.7%.

Mn: 1.0 to 2.3%

Like Si, Mn is an effective element for solid solution strengthening of steel, and increases hardenability of steel to facilitate the formation of the bainite phase during the cooling after hot rolling. However, when the content is less than 1.0%, the above effects may not be obtained due to the addition, and when the content exceeds 2.3%, the hardenability greatly increases, so the martensite phase transformation is easy to occur, and a segregation portion is greatly developed in the center of the thickness when casting the slab in the continuous casting process, and by the cooling after hot rolling, the microstructure in the thickness direction is formed non-uniformly, resulting in deteriorating the shear formability and durability. Therefore, in the present invention, the content of Mn is preferably limited to 1.0 to 2.3%. More preferably, the content of Mn is limited to the range of 1.1 to 2.0%.

Cr: 0.005 to 1.0%,

Cr is the solid solution strengthening element of the steel and delays the ferrite phase transformation during cooling, thereby helping to form the bainite at the coiling temperature. However, when the content is less than 0.005%, the above effects may not be obtained according to the addition, and when the content exceeds 1.0%, the ferrite transformation is excessively delayed, and thus, the elongation deteriorates due to the formation of the martensite phase. In addition, similar to Mn, the segregation portion in the center of the thickness is greatly developed, and the microstructure in the thickness direction is non-uniform, resulting in deteriorating the shear formability and durability. Therefore, in the present invention, the content of Cr is preferably limited to 0.005 to 1.0%. More preferably, the content of Cr is limited to 0.3 to 0.9%.

P: 0.001 to 0.05%

Like Si, P has the effect of the solid solution strengthening and promoting the ferrite transformation at the same time. However, when the content is less than 0.001%, it is economically disadvantageous because it requires a lot of manufacturing cost and it is insufficient to obtain strength, and when the content exceeds 0.05%, brittleness occurs due to grain boundary segregation, microcracks are easy to occur during forming, and the formability and durability greatly deteriorate. Therefore, it is preferable to control the content of P in the range of 0.001 to 0.05%.

S: 0.001 to 0.01%

S is an impurity present in steel. When the content exceeds 0.01%, S combines with Mn and the like to form non-metallic inclusions. As a result, there is a problem in that it is easy to cause microcracks during cutting of steel and greatly reduces the shear formability and durability. On the other hand, when the content is less than 0.001%, it takes a lot of time during a steelmaking operation, resulting in lowering productivity. Therefore, in the present invention, it is preferable to control the content of S in the range of 0.001 to 0.01%.

Sol. Al: 0.01 to 0.1%,

Sol. Al is a component mainly added for deoxidation. When the content is less than 0.01%, the effect of the addition is insufficient, and when the content exceeds 0.1%, the AlN combines with nitrogen to form AlN, so corner cracks are likely to occur in slab during the continuous casting, and defects are likely to occur due to the formation of inclusions. Therefore, in the present invention, it is preferable to control the content of S in the range of 0.01 to 0.1%.

N: 0.001 to 0.01%

N is a representative solid solution strengthening element together with C, and forms coarse precipitates together with Ti, Al, and the like. In general, the solid solution strengthening effect of N is superior to that of carbon, but there is a problem in that toughness is greatly reduced as the amount of N in steel increases. In addition, in order to produce a steel having less than 0.001% N, it takes a lot of time during the steelmaking operation, resulting in lowering productivity. Therefore, in the present invention, it is preferable to control the content of N in the range of 0.001 to 0.01%.

Ti: 0.005 to 0.11%

Ti is a representative precipitation strengthening element and forms coarse TiN in steel due to a strong affinity with N. TiN has the effect of suppressing a growth of grains during a heating process for hot rolling. In addition, Ti remaining after reacting with nitrogen is dissolved in steel and combined with carbon to form TiC precipitates, which is a useful component for improving the strength of the steel. However, when the content of Ti is less than 0.005%, the above effects may not be obtained, and when the content of Ti content exceeds 0.11%, there is a problem in that collision resistance properties of the steel manufactured after formation deteriorates due to the generation of coarse TiN and the coarsening of the precipitates. Therefore, in the present invention, it is preferable to limit the content of Ti in the range of 0.005 to 0.11%, and more preferably to control the content of Ti in the range of 0.01 to 0.1%.

Nb: 0.005 to 0.06%

Nb is a representative precipitation strengthening element together with Ti, and is precipitated during the hot rolling, and thus, effectively improves the strength and impact toughness of steel due to the effect of grain refinement by the delayed recrystallization. However, when the content of Nb is less than 0.005%, the above effects may not be obtained, and when the content of Nb exceeds 0.06%, there is problem in that the formability and durability of the steel deteriorates due to the formation of elongated grains and coarse composite precipitates resulted from the excessive recrystallization delay during the hot rolling. Therefore, in the present invention, it is preferable to limit the content of Nb in the range of 0.005 to 0.06%, and more preferably to control the content of Nb in the range of 0.01 to 0.06%.

The remaining component of the present invention is iron (Fe). However, in a general manufacturing process, unintended impurities may inevitably be mixed from a raw material or the surrounding environment, and thus, these impurities may not be excluded. Since these impurities are known to anyone of ordinary skill in the manufacturing process, all the contents are not specifically mentioned in the present specification.

Meanwhile, according to the present invention, the high strength steel has a microstructure comprising, in percentage by area, less than 5% of a pearlite phase including nitride and coarse carbide having a diameter of 1 μm or more, less than 10% of a bainite phase, less than 5% of a martensite and austenite (MA) phase, and a remainder of a ferrite phase.

When the pearlite phase is 5% or more, it is easy to generate microcracks at an interface between the matrix structure and the pearlite phase during the shear forming of the parts, and the durability of the parts deteriorates.

When the bainite phase is 10% or more, the strength of the steel excessively increases and the ductility of the steel decreases, resulting in deteriorating the formability.

When the MA phase is 5% or more, it is easy to generate microcracks at an interface between the matrix structure and the MA phase during the shear forming of the parts, and the durability of the parts deteriorates.

Furthermore, the high-strength steel of the present invention may have a ratio of fatigue limit and yield strength of 0.15 or more and a yield ratio of 0.8 or more.

Next, a method for manufacturing thick high-strength steel having a high yield ratio and excellent durability of the present invention will be described in detail.

According to the present invention, the method for manufacturing high-strength steel comprises reheating a steel slab having the composition component as described above, producing a hot-rolled steel sheet by performing finish hot rolling on the reheated steel slab at a finish hot rolling temperature (FDT) satisfying the following [Relational Expression 1], and cooling the hot-rolled steel sheet at a cooling rate (CR) that satisfies the following [Relational Expression 2] to a cooling termination temperature in a range of 450 to 650° C., and then coiling the hot-rolled steel sheet, in which, when a length of the hot-rolled steel sheet constituting a coiled coil is L, an average cooling termination temperature range for a corresponding portion of the hot-rolled steel sheet to a 0 to L/5 region of a head portion of the coiled coil is controlled to A1 (550 to 650° C.), the average cooling termination temperature range for the corresponding portion of the hot-rolled steel sheet to a L/5 to 2L/3 region of the coiled coil is controlled to A2 (450 to 550° C.), the average cooling termination temperature range for the corresponding portion of the hot-rolled steel sheet to a 2L/3 to L region of the coiled coil is controlled to A3 (550 to 650° C.), and the A1-A2 and A3-A2 values are controlled at 100° C. or higher, respectively.

First, in the present invention, the steel slab having the above composition component is reheated at a temperature of 1200 to 1350° C. In this case, when the reheating temperature is less than 1200° C., the precipitates are not sufficiently re-dissolved, so the formation of the precipitates in the process after the hot rolling decreases, and the coarse TiN remains. When the reheating temperature exceeds 1350° C., the strength decreases due to abnormal grain growth of austenite grains, so the reheating temperature is preferably limited to 1200 to 1350° C.

Next, in the present invention, the hot-rolled steel sheet is produced by performing the finish hot rolling on the reheated steel slab at the finish hot rolling temperature (FDT) that satisfies the following [Relational Expression 1] of the steel.

$$Tn-50 \leq FDT \leq Tn$$

$$Tn=730+92\times[C]+70\times[Mn]+45\times[Cr]+780\times[Nb]+520\times[Ti]-80\times[Si]-1.4\times(t-5) \quad \text{[Relational Expression 1]}$$

C, Mn, Cr, Nb, Ti, and Si in the above Relational Expression 1 are % by weight of the corresponding alloy element.

the FDT of the above Relational Expression 1 is a temperature (° C.) of a hot-rolled sheet at a termination time point of the hot rolling.

t of the Relational Expression 1 is a thickness of a final rolled sheet material (mm).

The recrystallization delay during the hot rolling promotes the ferrite phase transformation during the phase transformation, thereby contributing to the formation of fine and uniform grains in the center of the thickness and increasing the strength and durability. In addition, due to the promotion of the ferrite phase transformation, the untransformed phase decreases during the cooling, and the fraction of the coarse MA phase and martensite phase decreases and the coarse carbide or pearlite structure decreases in the center of the thickness where the cooling rate is relatively slow, so the problem resulted from non-uniform structure of the hot-rolled steel sheet is resolved.

However, it is difficult to make the microstructure uniform in the center of the thickness of a thick material having a thickness of 5 mm or more in a common level of rolling technology. When the hot rolling is performed at an excessively low temperature in order to obtain the effect of the recrystallization delay in the center of the thickness, the deformed structure is developed strongly at the range of thickness from the surface of the rolled steel to a t/4 position. As a result, the non-uniformity of the microstructure with the center of the thickness increases, so that the microcracks are likely to occur in the non-uniform portion during the shear deformation or punching deformation, thereby deteriorating the durability of the parts. Therefore, as shown in the above Relational Expression 1, the above effect may be obtained only when the hot rolling is completed at a temperature between Tn temperature and Tn-50, which Tn is the temperature at which the recrystallization delay starts to be suitable for the thick material.

When the hot rolling terminates at a temperature higher than Tn, the recrystallization delay effect decreases, and the coarse grains are formed in the center, making it difficult to obtain the uniform microstructure, and when the hot rolling terminates at a temperature lower than Tn-50, it is difficult to obtain the uniform microstructure because the microstructure elongated in the rolling direction is developed at a thickness range from the just low of surface layer of the steel to the t/4 position.

Meanwhile, the hot rolling preferably starts at a temperature in the range of 800 to 1000° C. When the hot rolling starts at a temperature higher than 1000° C., the temperature of the hot-rolled steel sheet increases, so the grain size becomes coarse and the quality of the surface of the hot-rolled steel sheet deteriorates. On the other hand, when the hot rolling is performed at a temperature lower than 800° C., the elongated grains are developed due to the excessive recrystallization delay, resulting in severe anisotropy and poor formability, and when the rolling is performed at a temperature lower than the austenite temperature range, the non-uniform microstructure may be developed more severely.

In the present invention, the hot-rolled steel sheet is cooled at a cooling rate (CR) that satisfies the following [Relational Expression 2] to a cooling termination temperature in a range of 450 to 650° C., and then coiled.

$$CR \geq 196-300\times[C]+4.5\times[Si]-71.8\times[Mn]-59.6\times[Cr]+187\times[Ti]+852\times[Nb] \quad \text{[Relational Expression 2]}$$

In the above Relational Expression 2, the CR is a cooling rate (° C./sec) during cooling to an A2 average cooling termination temperature after the FDT.

C, Si, Mn, Cr, Ti, and Nb in the above Relational Expression 2 are % by weight of the corresponding alloy element.

In the present invention, it is preferable to limit the cooling termination temperature, that is, the coiling temperature in a range of 450 to 650° C. When the coiling temperature exceeds 650° C., the coarse ferrite phase and the pearlite phase are formed, and thus, the strength of the steel is insufficient, and at the same time, the shear quality deteriorates, so the durability may deteriorate. On the other hand, when the coiling temperature is less than 450° C., the martensite phase and the bainite phase may be excessively formed to deteriorate the shear formability, the punching formability, and the durability, and the formation of fine precipitates may be insufficient to reduce the yield strength.

Meanwhile, in the present invention, when a length of the hot-rolled steel sheet constituting a coiled coil is L, an average cooling termination temperature range for a corresponding portion of the hot-rolled steel sheet to a 0 to L/5 region of a head portion of the coiled coil is controlled to A1 (550 to 650° C.), the average cooling termination temperature range for the corresponding portion of the hot-rolled steel sheet to a L/5 to 2L/3 region of the coiled coil is controlled to A2 (450 to 550° C.), the average cooling termination temperature range for the corresponding portion of the hot-rolled steel sheet to a 2L/3 to L region of the coiled coil is controlled to A3 (550 to 650° C.), and the A1-A2 and A3-A2 values are controlled at 100° C. or higher, respectively.

When the thickness of the rolled sheet exceeds mm, the coarse ferrite phase is formed because the cooling rate in the center of the thickness is slower than a t/4 position just below the surface layer of the rolled sheet thickness during the cooling after hot rolling, and solid solution C remains in the untransformed region to form the coarse carbide and pearlite structure. In particular, the coarse carbide and pearlite structure are more developed after coiling because the cooling rate of the coil is slower after coiling so that the carbide and the pearlite structure are maintained for a long time in the temperature range where the carbide and the pearlite structure are easily formed. In order to suppress the formation of such coarse carbide and pearlite structure, the cooling termination temperature should be lowered during the cooling after hot rolling. In this case, the bainite phase is formed and the formation of the fine precipitates is delayed, so it is not possible to obtain the high yield strength. In addition, the MA phase is also formed, resulting in the microcracks during the punching or shear forming and deteriorating the durability.

Therefore, in the present invention, in order to increase the cooling rate in the inner coiling portion of the coil and reduce the time maintained at a high temperature, a method of differently setting a cooling termination temperature during cooling after hot rolling into three regions is suggested. That is, when a length of the hot-rolled steel sheet constituting the coiled coil is L, the average cooling termination temperature range for the corresponding portion of the hot-rolled steel sheet to a 0 to L/5 region of the head portion of the coiled coil is controlled to A1 (550 to 650° C.), the average cooling termination temperature range for the corresponding portion of the hot-rolled steel sheet to a L/5 to 2L/3 region of the coiled coil is controlled to A2 (450 to 550° C.), and the average cooling termination temperature range for the corresponding portion of the hot-rolled steel sheet to a 2L/3 to L region of the coiled coil is controlled to A3 (550 to 650° C.)

The A1-A2 and A3-A2 values are controlled to be 100° C. or higher (preferably 100° C. or higher and 150° C. or lower), respectively. When the difference in the average cooling termination temperature is less than 100° C., it is difficult to obtain the above-described effect. In addition, when the difference in the average cooling termination temperature exceeds 150° C., the above effect does not increase further and it may be difficult to control the temperature for each cooling section of the coil.

In addition, the cooling rate to each cooling termination temperature needs to satisfy the above Relational Expression 2 in order to induce an appropriate range of ferrite phase transformation and promote the formation of the fine precipitates. Here, the cooling rate is obtained as the difference between the A2 which is the average cooling termination temperature corresponding to the inner coiling portion of the coil and the FDT. When the cooling rate does not satisfy the Relational Equation 2 and is thus cooled slowly, the coarse ferrite phase is formed so that the carbide is formed, or the MA phase is easily formed to make the microstructure become non-uniform, resulting in deteriorating the quality of the shear forming and the durability.

In the present invention, the region of the coiling coil is not set in exactly three equal parts. This is because the cooling rate from the head part to the inner coiling portion of the coil in the normally air-cooled coil is slow about 1.5 to 3 times than that of the outer coiling portion of the coil.

When the cooling conditions as described above are simultaneously satisfied, it is possible to obtain the thick high-strength hot-rolled steel sheet having suitable strength, formability and durability. This is because a relatively uniform and fine microstructure is formed in a thickness direction and the coarse carbide or pearlite structure is reduced in the inner coiling portion of the coil with a slow cooling rate and in the center of the thickness, so the non-uniform structure of the hot-rolled steel sheet is removed. In addition, the MA phase or the martensite phase is formed in the outer coiling portion and the edge portion of the coil with a high cooling rate, so the non-uniform structure is easily formed, while the formation of the MA phase and the martensite phase could be suppressed in the present invention.

Accordingly, the present invention may provide a thick high-strength steel having a high yield ratio and excellent durability that has a microstructure comprising, in percentage by area, less than 5% of a pearlite phase including nitrides and coarse carbides having a diameter of 1 μm or more, less than 10% of a bainite phase, and less than 5% of a martensite and austenite (MA) phase, and the remaining of a ferrite phase, and has a ratio of fatigue limit and yield strength of 0.15 or more and a yield ratio of 0.8 or more.

Thereafter, in the present invention, the coiled coil may be air-cooled to a temperature ranging from room temperature to 200° C. The air cooling of the coil means cooling in the air at room temperature at a cooling rate of 0.001 to 10° C./hour. In this case, when the cooling rate exceeds 10° C./hour, some untransformed phases in the steel are easily transformed into the MA phase, and thus, the shear formability, punching formability, and durability of the steel deteriorate, whereas it is economically disadvantageous to control the cooling rate to less than 0.001° C./hour because the separate heating and thermal insulation facilities are required. Preferably, it is preferable to perform cooling at 0.01 to 1° C./hour.

Alternatively, in the present invention, the method may further include pickling and oiling the coiled steel sheet after the cooling.

The method may further include heating the pickled or oiled steel sheet to a temperature in a range of 450 to 740° C., followed by hot-dip galvanizing.

In the present invention, the hot-dip galvanizing may use a plating bath comprising 0.01 to 30% by weight of magnesium (Mg), 0.01 to 50% by weight of aluminum (Al), the remaining of Zn, and unavoidable impurities.

MODE FOR INVENTION

Hereinafter, the present disclosure will be described in more detail through Inventive Examples.

Inventive Example

TABLE 1

| Steel Type | C | Si | Mn | Cr | Al | P | S | N | Ti | Nb | Thickness(mm) |
|---|---|---|---|---|---|---|---|---|---|---|---|
| 1 | 0.07 | 0.5 | 1.8 | 0.2 | 0.03 | 0.008 | 0.004 | 0.004 | 0.05 | 0.02 | 9 |
| 2 | 0.07 | 0.04 | 1.7 | 0.3 | 0.03 | 0.01 | 0.005 | 0.004 | 0.05 | 0.03 | 8 |
| 3 | 0.06 | 0.3 | 1.9 | 0.2 | 0.03 | 0.008 | 0.004 | 0.004 | 0.005 | 0.05 | 10 |
| 4 | 0.07 | 0.04 | 1.7 | 0.6 | 0.03 | 0.01 | 0.005 | 0.004 | 0.05 | 0.005 | 7 |
| 5 | 0.06 | 0.5 | 2.1 | 0.007 | 0.03 | 0.005 | 0.004 | 0.005 | 0.04 | 0.03 | 10 |
| 6 | 0.07 | 0.5 | 1.6 | 0.008 | 0.03 | 0.01 | 0.003 | 0.004 | 0.08 | 0.045 | 9 |
| 7 | 0.07 | 0.4 | 2.2 | 0.012 | 0.03 | 0.007 | 0.004 | 0.004 | 0.1 | 0.02 | 9 |
| 8 | 0.07 | 0.5 | 1.6 | 0.008 | 0.03 | 0.01 | 0.003 | 0.004 | 0.08 | 0.03 | 9 |
| 9 | 0.16 | 0.55 | 1.6 | 0.2 | 0.03 | 0.01 | 0.003 | 0.004 | 0.07 | 0.03 | 9 |
| 10 | 0.08 | 1.2 | 2 | 0.3 | 0.03 | 0.01 | 0.003 | 0.004 | 0.06 | 0.025 | 8 |
| 11 | 0.08 | 0.5 | 0.8 | 0.8 | 0.03 | 0.01 | 0.003 | 0.004 | 0.05 | 0.035 | 7 |
| 12 | 0.07 | 0.5 | 2.5 | 0.01 | 0.03 | 0.01 | 0.003 | 0.004 | 0.07 | 0.03 | 8 |
| 13 | 0.08 | 0.5 | 1.7 | 1.1 | 0.03 | 0.01 | 0.004 | 0.004 | 0.05 | 0.03 | 8 |
| 14 | 0.06 | 0.05 | 1.5 | 0.05 | 0.03 | 0.005 | 0.003 | 0.005 | 0.095 | 0.03 | 6 |
| 15 | 0.06 | 0.3 | 1.2 | 0.9 | 0.03 | 0.01 | 0.003 | 0.005 | 0.04 | 0.04 | 7 |
| 16 | 0.08 | 0.5 | 1.7 | 0.5 | 0.03 | 0.01 | 0.003 | 0.005 | 0.06 | 0.05 | 8 |
| 17 | 0.07 | 0.3 | 1.6 | 0.7 | 0.03 | 0.008 | 0.003 | 0.005 | 0.1 | 0.015 | 9 |
| 18 | 0.07 | 0.1 | 1.5 | 0.6 | 0.03 | 0.01 | 0.002 | 0.004 | 0.07 | 0.035 | 9 |
| 19 | 0.09 | 0.1 | 1.85 | 0.8 | 0.03 | 0.01 | 0.003 | 0.004 | 0.05 | 0.04 | 8 |
| 20 | 0.11 | 0.5 | 1.95 | 0.7 | 0.03 | 0.01 | 0.003 | 0.004 | 0.06 | 0.045 | 8 |

* In Table 1, units of alloy components are % by weight, and the remaining components are Fe and unavoidable impurities.

TABLE 2

| Steel Type | Division | FDT (° C.) | C1 (° C.) | C2 (° C.) | C3 (° C.) | CR (° C./sec) | Relational Expression 1 Tn | Relational Expression 1 Tn − 50 | Relational Expression 2 |
|---|---|---|---|---|---|---|---|---|---|
| 1 | Comparative Example 1 | 875 | 595 | 460 | 601 | 83 | 859 | 809 | 57.5 |
| 2 | Comparative Example 2 | 840 | 582 | 456 | 588 | 96 | 902 | 852 | 65.2 |

TABLE 2-continued

| Steel Type | Division | FDT (° C.) | C1 (° C.) | C2 (° C.) | C3 (° C.) | CR (° C./sec) | Relational Expression 1 Tn | Relational Expression 1 Tn − 50 | Relational Expression 2 |
|---|---|---|---|---|---|---|---|---|---|
| 3 | Comparative Example 3 | 865 | 622 | 618 | 635 | 75 | 881 | 831 | 71.5 |
| 4 | Comparative Example 4 | 860 | 452 | 470 | 463 | 78 | 900 | 850 | 26.0 |
| 5 | Comparative Example 5 | 855 | 476 | 589 | 462 | 62 | 872 | 822 | 59.1 |
| 6 | Comparative Example 6 | 857 | 607 | 471 | 595 | 78 | 865 | 815 | 110.2 |
| 7 | Comparative Example 7 | 875 | 568 | 503 | 575 | 65 | 907 | 857 | 48.9 |
| 8 | Comparative Example 8 | 882 | 599 | 580 | 605 | 55 | 856 | 806 | 97.4 |
| 9 | Comparative Example 9 | 858 | 607 | 482 | 609 | 66 | 864 | 814 | 39.3 |
| 10 | Comparative Example 10 | 820 | 601 | 465 | 611 | 95 | 832 | 782 | 41.4 |
| 11 | Comparative Example 11 | 816 | 594 | 463 | 614 | 105 | 830 | 780 | 101.3 |
| 12 | Comparative Example 12 | 880 | 602 | 468 | 599 | 92 | 916 | 866 | 30.8 |
| 13 | Comparative Example 13 | 875 | 595 | 472 | 608 | 82 | 902 | 852 | 14.5 |
| 14 | Inventive Example 1 | 865 | 592 | 465 | 602 | 109 | 896 | 846 | 107.9 |
| 15 | Inventive Example 2 | 860 | 607 | 477 | 575 | 95 | 876 | 826 | 78.1 |
| 16 | Inventive Example 3 | 870 | 587 | 465 | 580 | 92 | 892 | 842 | 69.2 |
| 17 | Inventive Example 4 | 880 | 608 | 472 | 587 | 86 | 901 | 851 | 46.2 |
| 18 | Inventive Example 5 | 872 | 592 | 478 | 603 | 88 | 906 | 856 | 69.9 |
| 19 | Inventive Example 6 | 890 | 585 | 462 | 590 | 90 | 938 | 888 | 23.4 |
| 20 | Inventive Example 7 | 875 | 589 | 466 | 608 | 93 | 918 | 868 | 20.1 |

The steel slab having the composition components shown in Table 1 was prepared. Then, the steel slab prepared as described above was hot-rolled, cooled and coiled under the conditions shown in Table 2 to produce the coiled hot-rolled steel sheet. After the coiling, the cooling rate of the steel sheet was maintained to be constant at 1° C./hour.

Meanwhile, when the length of the hot-rolled steel sheet constituting the coiled coil is L, in Table 2, A1 represents the average cooling termination temperature for the corresponding portion of the hot-rolled steel sheet to a 0 to L/5 region of the head portion of the coiled coil, A2 represents the average cooling termination temperature for the corresponding portion of the hot-rolled steel sheet to a L/5 to 2L/3 region of the coiled coil, and A3 represents the average cooling termination temperature for the corresponding portion of the hot-rolled steel sheet to a 2L/3 to L region of the coiled coil. Table 2 illustrates the calculation results of Relational Expressions 1 and 2, respectively.

Table 3 below showed the microstructure, mechanical properties, and durability evaluation results of steels corresponding to Inventive Examples and Comparative Examples.

Here, YS, TS, YR, and T-El mean 0.2% off-set yield strength, tensile strength, and breakage elongation, and are the results of testing by taking the JIS 5 standard test piece in a direction perpendicular to the rolling direction.

In the present invention, durability was obtained by tensile/compression fatigue test for a test piece having a punch forming part. Specifically, the fatigue test piece was used by punching a hole with a diameter of 10 mm in the center of the fatigue test piece with a total length of 250 mm, a width of 45 mm, a gauge length of 30 mm, and a curvature of 100 mm under the condition of a clearance of 12%, and the test was performed under the fatigue test condition of R (stress ratio)=−1 sine waveform 15 Hz. The fatigue strength ($S_{Fatigue}$) was determined as the strength when $10^5$ cycles were applied during the fatigue test, and was compared with the yield strength of the material and represented as a strength ratio ($S_{Fatigue}$/YS) so the changes in the cross-sectional quality and durability of the punching portion that change according to the microstructure of the steel plate were confirmed.

In addition, the steel microstructure is the result of analysis in the center of the hot-rolled sheet, and the area fraction of the MA phase was measured using an optical microscope and an image analyzer after the etching with the Lepera etching method, and the results of the analysis at 1000 magnification are shown. In addition, the phase fractions of ferrite (F), bainite (B) and pearlite (P) were measured from the results of analysis at 3000 and 5000 magnifications using the scanning electron microscope (SEM). Here, F is a polygonal ferrite having an equiaxed crystal shape, and B includes a bainite phase and a ferrite phase observed in a low temperature range such as needle-shaped ferrite and bainitic ferrite. In addition, P includes the pearlite phase and the nitride and coarse carbide having a diameter of 1 μm or more.

TABLE 3

| Steel Type | Division | YS (MPa) | TS (MPa) | YR (YS/TS) | T-El (%) | Ferrite Phase Fraction (%) | Bainite Phase Fraction (%) | Pearlite Phase Fraction (%) | MA Phase Fraction (%) | $S_{Fatigue}$ (MPa) | $S_{Fatigue}$/YS |
|---|---|---|---|---|---|---|---|---|---|---|---|
| 1 | Comparative Example 1 | 491 | 590 | 0.83 | 25 | 92 | 5 | 3 | 0 | 69 | 0.14 |
| 2 | Comparative Example 2 | 509 | 611 | 0.83 | 26 | 92 | 6 | 2 | 0 | 73 | 0.14 |
| 3 | Comparative Example 3 | 515 | 608 | 0.85 | 27 | 88 | 0 | 12 | 0 | 70 | 0.14 |
| 4 | Comparative Example 4 | 492 | 620 | 0.79 | 26 | 78 | 15 | 0 | 7 | 89 | 0.18 |
| 5 | Comparative Example 5 | 565 | 660 | 0.86 | 22 | 92 | 0 | 8 | 0 | 79 | 0.14 |
| 6 | Comparative Example 6 | 608 | 732 | 0.83 | 24 | 88 | 0 | 6 | 6 | 88 | 0.14 |
| 7 | Comparative Example 7 | 703 | 835 | 0.84 | 14 | 92 | 0 | 8 | 0 | 95 | 0.14 |
| 8 | Comparative Example 8 | 653 | 760 | 0.86 | 18 | 90 | 0 | 10 | 0 | 82 | 0.13 |
| 9 | Comparative Example 9 | 732 | 865 | 0.85 | 17 | 86 | 0 | 8 | 6 | 100 | 0.14 |
| 10 | Comparative Example 10 | 621 | 760 | 0.82 | 23 | 92 | 1 | 1 | 6 | 87 | 0.14 |
| 11 | Comparative Example 11 | 504 | 581 | 0.87 | 25 | 95 | 2 | 3 | 0 | 83 | 0.16 |
| 12 | Comparative Example 12 | 715 | 866 | 0.83 | 18 | 82 | 3 | 9 | 6 | 93 | 0.13 |
| 13 | Comparative Example 13 | 721 | 882 | 0.82 | 17 | 86 | 2 | 5 | 6 | 102 | 0.14 |
| 14 | Inventive Example 1 | 634 | 745 | 0.85 | 22 | 92 | 6 | 1 | 1 | 110 | 0.17 |
| 15 | Inventive Example 2 | 601 | 714 | 0.84 | 21 | 91 | 6 | 2 | 1 | 117 | 0.19 |
| 16 | Inventive Example 3 | 726 | 850 | 0.85 | 19 | 89 | 8 | 1 | 2 | 132 | 0.18 |
| 17 | Inventive Example 4 | 690 | 811 | 0.85 | 19 | 89 | 8 | 1 | 2 | 128 | 0.19 |
| 18 | Inventive Example 5 | 583 | 685 | 0.85 | 22 | 88 | 8 | 1 | 3 | 106 | 0.18 |
| 19 | Inventive Example 6 | 689 | 814 | 0.85 | 18 | 86 | 9 | 2 | 3 | 130 | 0.19 |
| 20 | Inventive Example 7 | 743 | 895 | 0.83 | 16 | 87 | 8 | 2 | 3 | 142 | 0.19 |

* In Table 3, F represents ferrite, B represents bainite, M represents martensite, and P represents pearlite.

As shown in Tables 1 to 3, it could be seen that all of Inventive Examples 1 to 7 satisfying the component range and producing conditions (Relational Expressions 1 and 2 and cooling termination temperature range) proposed in the present invention uniformly secure the targeted properties and durability.

On the other hand, Comparative Examples 1 and 2 are a case in which Relational Expression 1 presented in the present invention is not satisfied. Specifically, Comparative Example 1 is a case where the finish hot rolling temperature exceeds the range presented in Relational Equation 1, and the microstructure in the center of the steel is formed as the non-uniform structure in which the coarse ferrite phases, the pearlite phase, and the bainite phase are mixed, and a number of microcracks were observed in the punched cross-section portion, so the fatigue properties deteriorated. In addition, the yield strength and tensile strength do not reach the target value. Comparative Example 2 is a case where the hot rolling was performed in a temperature range below the range shown in Relational Equation 1, and the grains in the form of the elongated grains were formed in the center of the thickness by the hot rolling in the low temperature region, so it was determined that the fatigue destruction easily occurs along the weak grain boundary. This is because the micro-cracks formed in the center of the thickness during the punch forming developed along the elongated ferrite grain boundary.

Comparative Examples 3 to 5 are a case in which the cooling termination criterion for each location of the hot-rolled coil proposed in the present invention is not satisfied.

In Comparative Example 3, when the cooling termination temperature was high throughout the hot-rolled coil, a large amount of coarse carbide was observed in the grain boundary, and the pearlite structure was excessively developed. For this reason, the fatigue properties deteriorated.

In Comparative Example 4, when the cooling termination temperature was low throughout the hot-rolled coil, it was confirmed that the ferrite phase fraction was greatly reduced. The bainite phase and the MA phase were formed even in the center of the thickness with a slow cooling rate, the high yield ratio was not obtained due to the low yield strength, and the fatigue properties also deteriorate.

Comparative Example 5 is a case where the cooling termination temperature A2 of the region corresponding to the middle of the hot-rolled coil is higher than the cooling termination temperature of A1 and A3 of the region corresponding to the head and tail portions of the hot-rolled coil. In this case, the pearlite structure was developed in the microstructure in the center of the thickness, and the fatigue properties also deteriorated. This is because the region corresponding to the middle of the coil has a slower cooling rate than the head portion and outer coiling portions of the coil, so even if the A1 and A3 temperatures are lowered, when the A2 temperature is high, it is difficult to suppress the formation of the pearlite structure in the center of the thickness.

Comparative Example 6 is a case where the criterion of the cooling rate (CR) up to the cooling termination temperature A2 at the position corresponding to the mid portion of the hot-rolled coil after the hot rolling does not satisfy the Relational Expression 2. As such, when the cooling rate is slow, the coarse ferrite phase is formed during the initial ferrite phase transformation to have the non-uniform microstructure. In particular, the coarse carbide is formed around the grain boundary, and the MA phase is formed in the grains, and the non-uniform microstructure is also formed in the material thickness direction, so the formation of the microcracks increases in the punched cross-section portion, resulting in deteriorating the fatigue properties.

Comparative Example 7 is a case in which the temperature difference between the cooling termination temperatures A1-A2 and A3-A2 are less than 100° C., and even if the temperature of each region A1, A2, and A3 satisfies the respective temperature ranges suggested in the present invention, the cooling rate in the mid portion of the coil is slow, so there is no effect of suppressing the formation of the pearlite structure in the center of the thickness. Accordingly, the fatigue properties deteriorated.

Comparative Example 8 is a case that does not satisfy all of the criteria of Relational Expressions 1 and 2 and the cooling termination temperature A2 in the mid portion of the coil suggested in the present invention, and the fatigue properties deteriorated due to the formation of the non-uniform microstructure and the excessive formation of the pearlite phase.

On the other hand, Comparative Examples 9 to 13 are a case that does not satisfy the component range suggested in the present invention.

In Comparative Example 9, when the content of carbon C exceeds the C component range of the present invention, the pearlite and coarse carbide were mainly developed in the center of the thickness, and the MA phase also showed a tendency to increase toward the surface layer, so the fatigue properties deteriorated.

Comparative Example 10 is a case where the content of silicon Si exceeds the content range of the present invention, scale defects were severe on the surface of the steel sheet, and the formation of the coarse carbide and pearlite was greatly suppressed, but the formation of the MA phase was excessive. In addition, due to the excessive addition of Si, the hot-rolling temperature calculated in Relational Expression 1 corresponds to a low temperature region so that the microstructure elongated in the rolling direction was also formed, thereby deteriorating the fatigue properties.

Comparative Example 11 is a case where the content of manganese Mn is less than the Mn component range of the present invention. Mn is an alloy component that helps to improve the strength by forming the bainite structure by strengthening the solid solution and increasing the hardenability, but Comparative Example 11 lacks Mn, so it was difficult to obtain the target strength required in the present invention. Comparative Example 12 is a case where the content of Mn exceeds the Mn component range of the present invention, and a Mn segregation zone was severely formed in the center of the hot-rolled sheet, and the pearlite structure was developed in the center. Also, the MA phase increased toward the surface layer due to the increase in the hardenability, and cracks were excessively formed in the punched cross-section portion, and the fatigue properties also deteriorated.

Comparative Example 13 is a case in which the content of Cr exceeds the component range of the present invention, and the role of Cr in the steel showed characteristics similar to Mn, and showed a microstructure similar to that of Comparative Example 11, and the fatigue properties also deteriorated.

FIG. 1 is a photograph of observed microstructures of Inventive Example 5 in Examples of the present invention and Comparative Example 3. It could be seen that the pearlite structure and carbide were formed in the steel of Comparative Example 3 compared to Inventive Example 5.

The present invention is not limited to the above implementation examples and examples, but may be manufactured in a variety of different forms, and those of ordinary skill in the art to which the present invention pertains will understand that the present invention may be implemented in other specific forms without changing the technical spirit or essential features of the present invention. Therefore, it is to be understood that the implementation examples and examples described above are illustrative rather than being restrictive in all aspects.

The invention claimed is:

1. A steel having a high yield ratio and excellent durability, comprising:

in percentage by weight,

C: 0.05 to 0.15%,

Si: 0.01 to 1.0%,

Mn: 1.0 to 2.3%,

Al: 0.01 to 0.1%,

Cr: 0.005 to 1.0%,

P: 0.001 to 0.05%,

S: 0.001 to 0.01%,

N: 0.001 to 0.01%,

Nb: 0.005 to 0.07%,

Ti: 0.005 to 0.110%, and

Fe and unavoidable impurities; and a microstructure consisting of, in percentage by area, less than 5% of a pearlite phase including nitrides and coarse carbides having a diameter of 1 μm or more, less than 10% of a bainite phase, less than 5% of a martensite and austenite (MA) phase, and the remaining of a ferrite phase, wherein a ratio of fatigue limit and yield strength is 0.15 or more and a yield ratio is 0.8 or more.

2. The steel of claim 1, wherein the steel is a pickled and oiled steel.

3. The steel of claim 1, wherein the steel has a thickness of 5 mm or more.

4. The steel of claim 1, wherein the steel has a tensile strength of 650 MPa or more.

5. The steel of claim 1, comprising Si: 0.2 to 1.0%.

6. The steel of claim 1, comprising Al: 0.01 to 0.03%.

* * * * *